US006026628A

United States Patent [19]

Lopez

[11] Patent Number: 6,026,628

[45] **Date of Patent: *Feb. 22, 2000**

[54] CONSTRUCTION SYSTEM FOR PARTITION WALLS, WALLS AND EXTRADOSES

[76] Inventor: Miguel Pedreño Lopez, Edificio Las Tejas-Plaza 2, Benidorm, Spain

[ * ] Notice: This patent issued on a continued prosecution application filed under 37 CFR 1.53(d), and is subject to the twenty year patent term provisions of 35 U.S.C. 154(a)(2).

[21] Appl. No.: 08/544,023

[22] Filed: Oct. 17, 1995

[30] Foreign Application Priority Data

Jul. 21, 1995 [ES] Spain ..... 9501466

[51] Int. Cl.[7] ..... E04G 21/02; E04F 13/04

[52] U.S. Cl. ..... 52/745.09; 52/309.9; 52/309.12; 52/448; 52/453

[58] Field of Search ..... 52/220.7, 238.1, 52/239, 242, 220.3, 270, 271, 309.9, 309.12, 453, 443, 405.2, 404.4

[56] References Cited

U.S. PATENT DOCUMENTS

| | | | |
|---|---|---|---|
| 2,097,697 | 11/1937 | Marks | 52/238.1 X |
| 3,228,822 | 1/1966 | Norman | 52/220.3 X |
| 3,353,315 | 11/1967 | Barker | 52/443 X |
| 3,719,016 | 3/1973 | Randolph | 52/309.9 X |
| 4,318,258 | 3/1982 | Heck | 52/453 X |
| 4,363,351 | 12/1982 | Eriksen | 52/309.9 X |
| 4,769,963 | 9/1988 | Meyerson | 52/309.9 |
| 5,060,446 | 10/1991 | Beliveau | 52/404.4 X |
| 5,067,294 | 11/1991 | McGowan | 52/242 X |
| 5,067,296 | 11/1991 | Brown et al. | 52/404.4 X |
| 5,081,810 | 1/1992 | Emmert | 52/309.9 X |
| 5,172,532 | 12/1992 | Gibbar, Jr. | 52/309.12 |
| 5,353,560 | 10/1994 | Heydon | 52/270 X |
| 5,444,955 | 8/1995 | Ou | 52/220.7 |
| 5,515,659 | 5/1996 | MacDonald et al. | 52/309.12 X |

FOREIGN PATENT DOCUMENTS

| | | | |
|---|---|---|---|
| 1575724 | 7/1969 | France | 52/453 |
| 2240325 | 3/1975 | France | 52/309.12 |
| 2576052 | 7/1986 | France | 52/405.2 |
| 2583089 | 12/1986 | France | 52/309.9 |
| 3833962 | 2/1980 | Germany | 52/405.2 |
| 429093 | 7/1967 | Switzerland | 52/405.2 |

*Primary Examiner*—Michael Safavi
*Attorney, Agent, or Firm*—Ladas & Parry

[57] ABSTRACT

A system of construction based on the use of polystyrene boards for constructing partition walls as well as extradoses, these said boards being equipped with grooves for electrical and plumbing ducts, as well as for the formation of structural ribs, while their vertical edges are equipped with grooving and tonguing for their interconnection. Boards are put into place between the floor and ceiling, with the interposition of perimetrical perimeter strips made of the same material. Plaster with an additive is then used to coat the surfaces of the said boards as a finish which forms an adhesive paste. Vertical fixing strips facing each other on opposite sides play a role in the emplacement of the boards, while plastic mesh is placed at the joints between the boards and walls, to improve the joint and prevent cracks.

1 Claim, 3 Drawing Sheets

CONSTRUCTION SYSTEM FOR PARTITION WALLS, WALLS AND EXTRADOSES

This application claims priority from Spanish patent application No. P9501466 filed Jul. 21, 1995. Said document is incorporated herein by reference.

This invention relates to improvements in the systems for constructing partition walls, walls and extradoses, the evident object of which is to offer to the market and general public a new system of construction that is much more simple, rational, economical and effective than those which are currently known.

A system for constructing partition walls and walls is currently claimed by Spanish Patent of Invention number 8701409, by the same Applicant, in which a new method of constructing partition walls and walls is disclosed, based on the use of a special facing obtained by the allocation of expanded polystyrene boards of variable sizes, depending on needs, which are placed between the floor and ceiling, leaving a separation of 20 to 30 mm between them, and to which rough plaster is applied mixed with an adhesive and a retarder. The boards are set in place behind a line marked out by edging strips made of the same material. The application of the additivated plaster or adhesive paste is carried out by a spraying machine in two layers, one to affix the boards and the other to obtain a thickness of 15 mm on each of the two faces, as a fining-off or plaster coat of the facing.

This system eliminates the use of classic brick material, while also preventing all types of humidity. A very considerable reduction in weight is also achieved, together with a high degree of thermal and acoustic insulation, as well as many other advantages which are explained in detail in the specification of said U.S. Pat. No. 8,701,409.

The present application includes a series of improvements giving rise to technical advances allowing the whole construction to be undertaken without omitting any details whatsoever. That is, the present application specifies the technical features of the adhesive paste, which are optimimum in order to obtain the maximum efficiency in its function.

Likewise, a series of details have been introduced with reference to the structure of the polystyrene boards, with the aim of ensuring that they perform all their functions in the most efficient way, meeting all the needs of construction.

Another improvement refers to the way in which extradoses are obtained, together with the way in which the shelves are obtained, all of which makes possible a form of construction that is, in the broadest possible sense, innovative and advantageous in comparison with those systems currently in use.

More specifically, the special adhesive paste used in the system of construction which is the subject of the invention has the following technical features:

| Spray plaster material (INCE seal, B.O.E. (Official State Bulletin) 24/03/82) | |
|---|---|
| Average purity index | 94% |
| Granulometry | 7% maximum rejection at 800 |
| Surface hardness | >85 u. Shore C for A/Y = 0.65 |
| Resistance to flexotraction | 32.5 Kp/cm$^2$ for A/Y = 0.65 |
| Adherence to polystyrene | Above 2.26 kg/cm$^2$ |
| Thermal conductivity | K = 0.26 W/MC. |

The polystyrene boards are to be fire-resistant and made of expanded low density polystyrene (15 kg/M$^3$); rigid and of the thickness required (as from 6 cm of thickness for partitions). The height will be equivalent to the distance from the floor to the ceiling, minus 9 cm.

Structurally, the mentioned boards will have a wedge grooving and tonguing on their sides so that they match together as well as two continuous harizontal grooves parallel to the floor at a height of 40 cm and at 2.20 m, with the purpose of holding the general ducts used for electricity and plumbing. They are also to have a longitudinal (vertical) groove on each face, opposite to each other and at 10 cm from the grooving and tonguing ends, for the formation of ribbing.

In extradoses the boards may be of the normal type, of a thickness less than that recommended for partition walls.

The polystyrene strips used for offset or other purposes are to be of the same quality as the boards, 15 mm thick, of the required thickness and of a length determined by their manufacture, with normal edges and with one and/or two chamfers, depending on what they are to be used for.

The manner of construction of partition walls and walls is as follows:

1st. As is the case with traditional working practices, the process starts with the laying out of the place to be occupied by the partition wall or wall, using marks on the floor, as well as on the walls and ceiling showing how thick it will be. Once the site has been marked out, a 15 mm thick polystyrene strip perimeter is put into place using the adhesive paste. This strip is placed around the entire perimeter (floor, walls and ceiling) where the partition wall or wall is to be constructed. The perimeter strip is to be of the total width of the finished partition wall.

2nd. The 1.20 m wide (as manufactured) polystyrene boards are put into place vertically from floor to ceiling, subtracting 9 cm to the total height to allow for the application of polystyrene strips and leaving free spaces (near the floor and ceiling) so that structural ribs may be formed later of adhesive paste, holding the partition wall. The polystyrene boards must be free of harizontal joints and manufactured in only one piece. The thickness of the polystyrene board varies according to the needs of the work in question. The said boards are held by separators, which are used to separate frames in carpentry, from the perimeter strips on the floor and walls, the separation being 3 centimetres. The polystyrene boards have to be 3 cm thinner than the thickness of the perimeter strip, and are to be centered with the aim of leading 15 mm free space on each side, for the application of the plaster coat. For holding the polystyrene boards in place, a holding fixing strip is to be placed along their entire length of each of their faces in a vertical direction, on opposite locations and with 3 cm of their length protruding at both ends, upper and lower: the fixing strips are necessary and are installed to absorb possible fissures, as well as serving as guides for the final plastering of the facing. Extendable holders are affixed onto the strips, the purpose of these being to hold the 2 boards in place until the infilling of the free spaces and grooves from structural ribs and the coating of adhesive paste give strength to the partition wall. Door, cupboard and window frames are to be constructed simultaneously with the emplacement of the boards, and are also to be held in place by extendable holders, while holding clamps are also necessary for holding the carpentry to the extendible holders. Before frames are put into place, the 15 mm thick polystyrene strip, of equal width to the frame, is to be placed around their entire perimeter, in such a way that both materials form a single body (thereby avoiding possible cracks of the plaster coat) as well as the emplacement of jaws or holding clamps ensuring that they are perfectly affixed to the partition wall.

3rd. Once the boards are held and in place, together with the frames in the manner described above, the secondary channels or ducts are to be marked out, in which, once created, the other ducts for electricity wiring, which installation was pending during the formation process of the partition wall, are to be installed once the partition has been formed. The plumbing installation is also to be completed, together with the electrical and plumbing connection boxes. These marks are to be covered with stickers, adhesives or tapes to the width required by the planned ducts. At those points where the partition walls meet the brick or concrete wall forming an angle, they are to be reinforced with 15 cm wide plastic mesh from floor to ceiling, to ensure a better joint and to prevent possible cracks in the future. Following this, the adhesive paste is to be applied under pressure, until the free spaces between perimeter strips and boards, as well as the vertical and horizontal grooves have been filled up with adhesive paste. Both surfaces of the facing are then covered with a fine coating which is treated with a toothed trowel (or similar), with the aim of forming grooves or flutings in the surface (the faces of the board) to ensure the perfect adhesion of the following spray of adhesive paste in the plaster coat. This first coating of adhesive paste should not exceed a thickness of 5 mm. Before the paste dries the adhesive tapes are to be removed, leaving visible the marks for the connection boxes and ducts. When the coating has dried, or before starting on the final finishing coating, the facing is perforated with 3 cm diameter holes, each at a distance of 50/80 cm from the next, over the entire surface. Although this last operation is not necessary, as the material adheres sufficiently well to the polystyrene, it does mean that both faces of the facing may be joined by paste, thereby ensuring a higher quality of finish for the partition wall. These holes must be suppressed if a sound dampening effect is sought.

4th. Once the extendible holders have been taken off, channels are opened for secondary installations by means of a resistance in order to cut the facing quickly and cleanly or by means of an electric burner or gas burner, which on heating shrinks the polystyrene, leaving it prepared for completion of the plumbing and ducting installations, together with the electricity connection boxes which were not put into place during pre-installation and the inclusion of boards into the partition Horizontal and vertical precut grooves are used when it is possible.

5th. Lastly, with a mixer—sprayer the definitive finish of adhesive paste is to be applied to the facing prepared as described above, until a total thickness of 15 mm is achieved over each side of the partition, while the fixing strips are to be used to ensure the full screeding of the plaster, and finishing off with a floating finish by sponge and giving the final touches to the whole surface by knife or trowel. The dilation gap must be made in the ceiling is necessary, and must be made on the day following the finishing of the partition (if this is in fact plastered into the ceiling). The gaps to which this has given rise are then covered, with a coating of acrylic sealing paste, which applied and smoothed with a spatula will completely prevent the appearance of fissures in the facings.

Here follows a description of how extradoses may be constructed with the aim of creating an insulating space, joined to a brick or concrete wall:

1st. The polystyrene boards destined for the extrados are prepared on the floor or work bench, and adhesive paste is applied to the side that is to be joined to the wall. The boards are applied following the spraying of adhesive paste onto the brick or concrete wall. Before this, a 15 mm thick polystyrene perimeter strip is to have been placed around the entire perimeter to be treated, protruding 15 mm from the edge of the board, so that the thickness of the plaster coat is at the same level as the perimeter strip, and this work is finished in the same way as that involved in partitions.

2nd. The joints between the strips and the polystyrene boards are eliminated. The boards are put into place joined together. They may be of different sizes, although the polystyrene strip joining these boards must be covered in contact adhesive, to serve as a gasket, so that no cracks are left in the facing to prevent humidity (in the case of extradoses that are made on exterior walls, facades, internal patios, etc.). This joining strip may be omitted in interior extradoses, in which both pieces are simply joined without leaving any cracks.

3rd. The conventional wall (of bricks and/or concrete) is insulated by the thickness of the strip of polystyrene (between the layer of paste applied onto the wall for affixing the polystyrene, and the final coat of plaster that is sprayed onto the board) due to the fact that as these are different materials, they behave in different ways in terms of shrinkage, dilation and settling, these factors having differing degrees of influence on them, so that it is necessary to place vertical fixing strips at a distance of approximately one metre to prevent the formation of cracks, as well as at the prolongations of jambs, door jambs and windows, to such a length that these come into contact with floor and ceiling. The extrados is a floating facing, as are the partitions, and for this reason the perimeter of the joint between the extrados and walls and ceiling has to be treated in the same way, i.e., creating the same dilation gap as is used in the case of partition walls, on which a line of acrylic sealant is then applied, to absorb and eliminate all dilations and shrinkages, or other movements at the site which may come about.

Shelves are to be made in the following manner:

These may consist of any polystyrene board that has been covered on both sides with adhesive paste. Boards are made according to requirements, although they may be cut to change their size once they have been prepared, and they may also be joined and glued together according to the requirements of the final design needed. As these parts are easy to handle they are prefabricated before fixation to a wall or partition, as transporting or manipulating them gives rise to no danger at all, and they may also be made oversize, given that no difficulties arise in cutting them. Once shelves are finished, dry and cut to size, they are set into the wall and affixed by adhesive paste on the edge for which this is planned, according to the lay-out and the groove cut, which is slightly deeper and wider than the shelf to be affixed. They may also be affixed using metal brackets duly fixed by screws onto the wall or partition, by lag screws or strong bolts able to withstand its weight. Shelves are finished by plastering the finish of the strip in the wall, their joints or connections and their front edges with adhesive paste.

The boards are to be made on the work bench, affixed in the same manner for executing a partition, or directly prepared on the floor, so that once cut and of the correct size they may be put into place.

The adhesive paste may also be used in fixing tiles into place, mixed with water either manually or with a machine, and applied either on the wall itself or on the part to be put into place.

Finally, the plastering of conventional ceilings or walls may take place in the traditional manner, or by the use of a mixer—sprayer machine, as used when the material to be so coated is polystyrene, and respecting the demanded thickness of 15 mm. The plastering of concrete or brick walls may be undertaken without any impediment, i.e., in the same way as, and conforming to, traditional practice.

As a complement to the description found below, and with the aim of aiding a better understanding of the features of this invention, a detailed description will be offered, on the basis of a set of drawings enclosed with this specification and constituting an integral part of the same, and in which merely as a guideline and not as a limitation in any way the following features have been illustrated:

FIG. 5 illustrates the formation of a shelf, as an example of such shelves described above.

Figure 1:
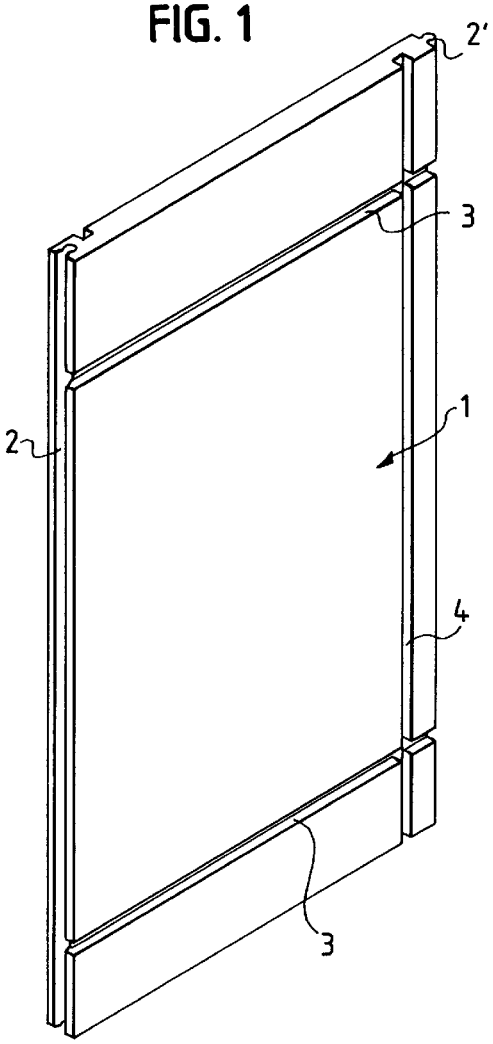
FIGS. 1, 2 and 3 show perspective, vertical and cross section views, respectively, of a polystyrene board created according to the improvements included in this invention.
Figure 2:
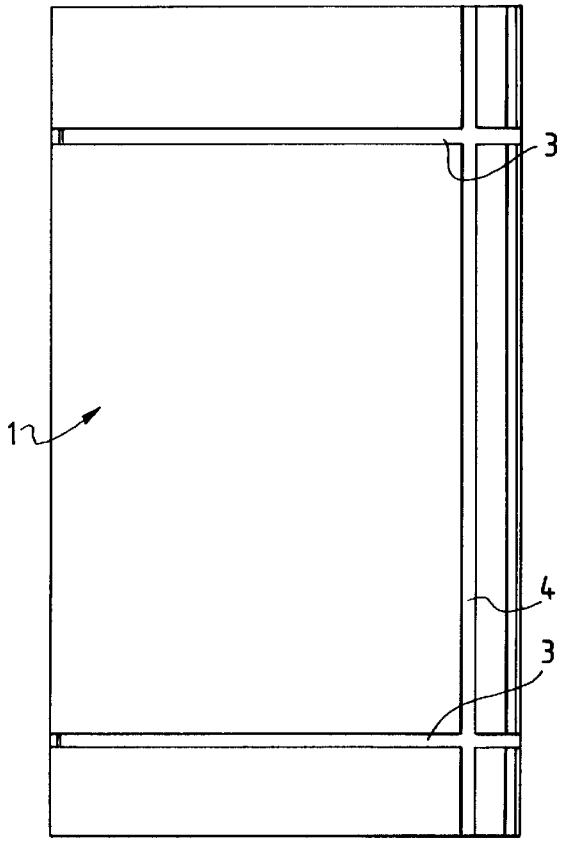
Figure 3:
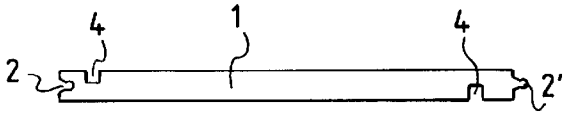

As may be seen from these figures, and specifically FIGS. 1 to 3, the polystyrene board (1) presents grooving and tonguing on its edges, in the form of a groove or channel (2) and a complementary protuberance (2'). It also presents horizontal grooves (3) close to the lower and upper edges, as well as a vertical groove (4) close to the sides, these grooves being present on both sides opposite to each other.

Figure 5:
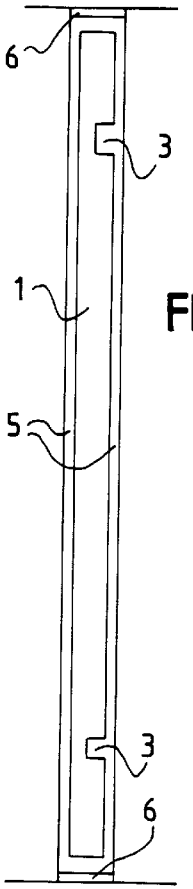
FIGS. 4, 5 and 6 show perspective, vertical and cross section views of a partition constructed according to the subject of the invention.
Figure 4:
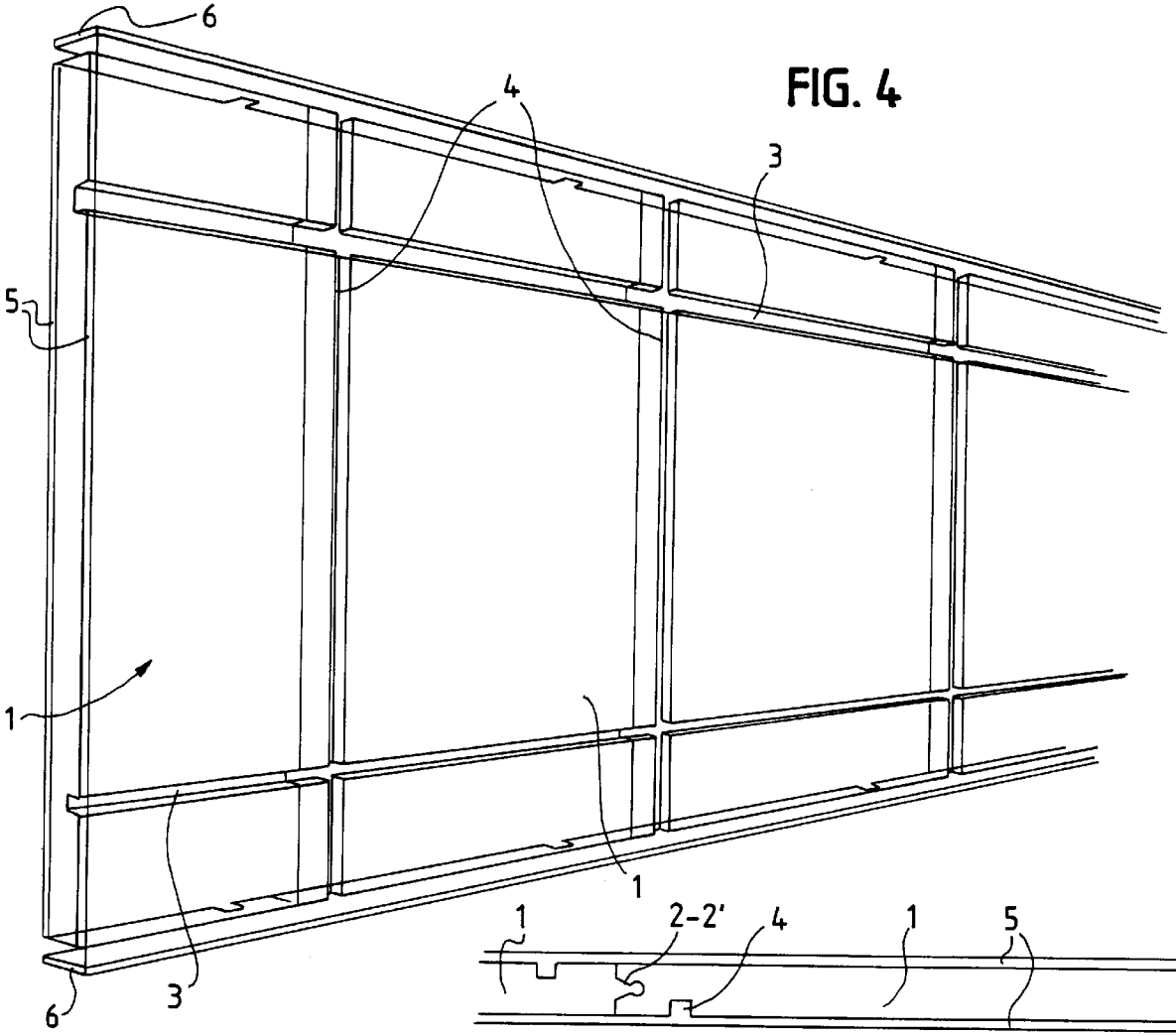
Figure 6:
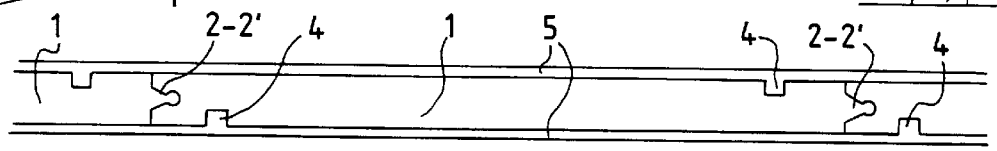

FIGS. 4 to 6 show the construction of a partition wall by means of the collateral arrangement of several boards (1) held together by grooving and tonguing (2–2') with a layer of plaster on both sides (5) formed by adhesive paste, while the erection of these said boards (1) is facilitated by the prior laying out of serimeter strips (6) made of the same material.

Figure 7:
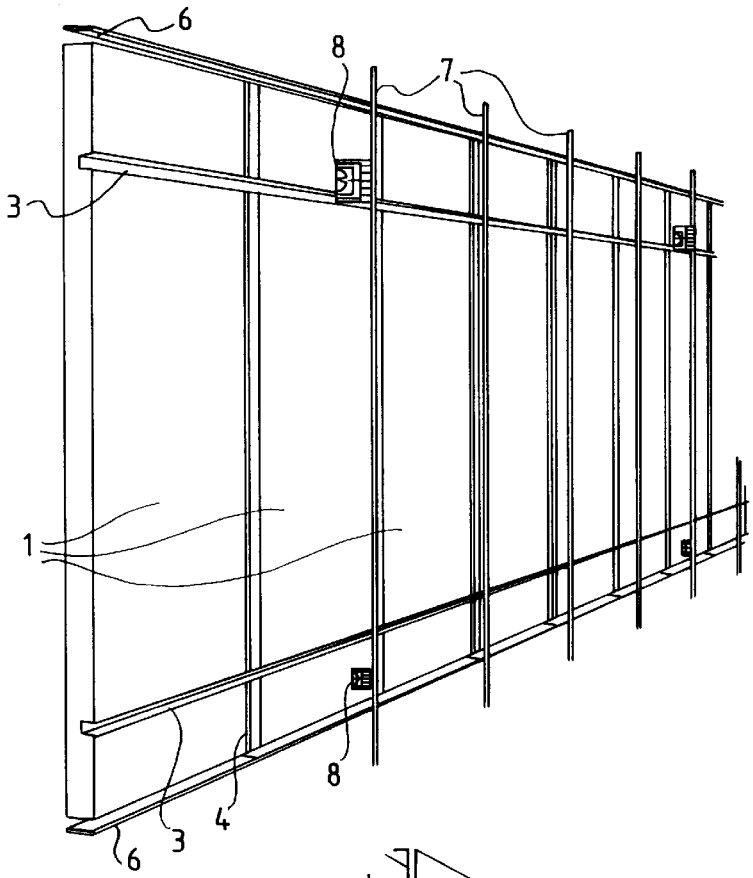
FIG. 7 shows a perspective view of a partition and the arrangement of strips and connection boxes.

FIG. 7 shows how for the partition to be formed it is necessary that the boards (1) are complemented with strips (7) fixing, while this figure also shows the connection boxes (8).

Figure 8:
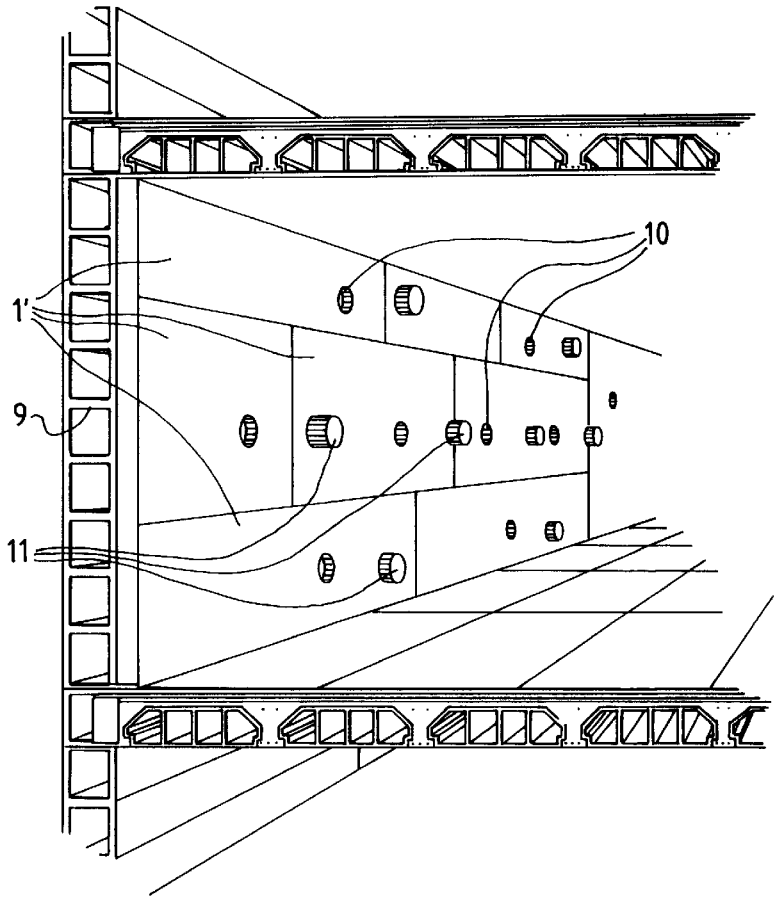
FIG. 8 shows a perspective view of an extrados constructed according to the invention.

FIG. 8 shows an extrados, in which a brick facing (9) has a plurality of boards (1') affixed to one of its faces, these boards being either the same or of different sizes, orifices having been made in them (10) to permit the escape of superfluous fixing material, following which function these are blocked using the polystyrene plugs (11) extracted from the board during its fixing, thereby sealing the extrados.

I claim:

1. Construction method of partition walls, walls and extradoses comprising the following steps;

marking out the place to be occupied by a partition wall or the like, using marks on the floor, as on the walls and ceiling showing how thick the wall will be;

placing into the marked out places perimeter polystyrene strips, fixing them to the floor, walls and ceiling with adhesive paste;

placing vertically between the perimeter strips, one piece polystyrene boards of such dimensions as to leave free spaces between the polystyrene boards and perimeter strips, said polystyrene boards having horizontal and vertical grooves near the top, bottom and side edges thereof; keeping the polystyrene boards in place by means of vertical fixing strips placed between the floor and ceiling perimeter strips on opposite sides of the polystyrene boards;

filling up with adhesive paste the free spaces left between the edges of said polystyrene boards and perimeter strips, and in said grooves of the polystyrene boards, two horizontal grooves placed close to the floor and ceiling, and two vertical grooves placed close to the vertical edges and on opposite sides of the polystyrene boards, the lateral edges of these boards being coupled by tongue and groove;

applying a thin coat of adhesive paste to both sides of the polystyrene boards, this coating being treated with a toothed trowel to form flutings in the surface;

applying by means of a sprayer a finish coating of adhesive paste over the surface prepared as described above until reaching the same thickness as those of the vertical fixing strips, using these fixing strips as guides for finishing the surface with a trowel or straight rule.

* * * * *